US009368859B2

(12) United States Patent
Forslund et al.

(10) Patent No.: US 9,368,859 B2
(45) Date of Patent: Jun. 14, 2016

(54) METHOD FOR INTEGRATING AN ANTENNA WITH A VEHICLE FUSELAGE

(71) Applicant: SAAB AB, Linkoeping (SE)

(72) Inventors: Ola Forslund, Sundyberg (SE); Henrik Holter, Saltsjoe-Boo (SE)

(73) Assignee: SAAB AB, Linkoeping (SE)

( * ) Notice: Subject to any disclaimer, the term of this patent is extended or adjusted under 35 U.S.C. 154(b) by 0 days.

(21) Appl. No.: 14/420,187

(22) PCT Filed: Oct. 9, 2012

(86) PCT No.: PCT/SE2012/051080
§ 371 (c)(1),
(2) Date: Feb. 6, 2015

(87) PCT Pub. No.: WO2014/058360
PCT Pub. Date: Apr. 17, 2014

(65) Prior Publication Data

US 2015/0207213 A1 Jul. 23, 2015

(51) Int. Cl.

| | |
|---|---|
| ***H01Q 1/32*** | (2006.01) |
| ***H01Q 1/27*** | (2006.01) |
| ***H01Q 17/00*** | (2006.01) |
| ***H01Q 21/06*** | (2006.01) |
| ***H01Q 9/04*** | (2006.01) |

(52) U.S. Cl.
CPC ..... *H01Q 1/27* (2013.01); *H01Q 1/3291* (2013.01); *H01Q 9/0407* (2013.01); *H01Q 17/00* (2013.01); *H01Q 21/065* (2013.01)

(58) Field of Classification Search
CPC ..... H01Q 21/061
USPC ..... 343/713
See application file for complete search history.

(56) References Cited

U.S. PATENT DOCUMENTS

| | | | | |
|---|---|---|---|---|
| 5,208,602 A * | 5/1993 | Monser | H01Q 21/26 343/795 |
| 6,023,244 A | 2/2000 | Snygg et al. | |
| 2005/0140561 A1 | 6/2005 | Marsan et al. | |

FOREIGN PATENT DOCUMENTS

| | | |
|---|---|---|
| FR | 2971630 A1 | 8/2012 |
| WO | WO 2010/056160 A1 | 5/2010 |

OTHER PUBLICATIONS

International Searching Authority, International Search Report and Written Opinion for International Application No. PCT/SE2012/051080, Jun. 13, 2013, 9 pages, Swedish Patent and Registration Office, Sweden.

* cited by examiner

*Primary Examiner* — Graham Smith
(74) *Attorney, Agent, or Firm* — Alston & Bird LLP

(57) ABSTRACT

An antenna frame for reducing radar cross section of a vehicle provided with a flat microstrip patch antenna array comprising a number of microstrip patches arranged in an array pattern, the antenna frame: —being arranged to surround the outer periphery of the flat antenna array —the frame comprising a first conductive sheet; —the first conductive sheet extending from the most peripheral patches and outward in a sloping manner; wherein dielectric and magnetic absorbent material are arranged to improve impedance transition from a point of the antenna to a point on the periphery of the frame, which is also contemplated as adjoining a vehicle fuselage.

14 Claims, 8 Drawing Sheets

METHOD FOR INTEGRATING AN ANTENNA WITH A VEHICLE FUSELAGE

CROSS REFERENCE TO RELATED APPLICATIONS

This application is a National Stage Application, filed under 35 U.S.C. §371, of International Application No. PCT/SE2012/051080, filed Oct. 9, 2012, the contents of which as are hereby incorporated by reference in its entirety.

BACKGROUND

1. Related Field

The present invention relates to the field of antennas. The invention also relates to the field of vehicle stealth technology. More specifically it relates to the integration of array antennas with the vehicle carrying it, in order to achieve improved stealth characteristics by reducing radar cross section of the combination of antenna and vehicle. In particular it relates to a method and to an antenna frame for this purpose.

2. Description of Related Art

The invention relates to the field of integration of an array antenna aperture with a vehicle structure with the intention of lowering vehicle radar cross section. In this field attempts have been made before with varying results.

BRIEF SUMMARY

The invention relates to the field of integration of array antenna apertures with vehicles, in particular with the intention of producing a low vehicle radar cross section. This may be difficult due to physical and mechanical characteristics of the antenna that often contributes to an increased radar cross section. The inventors have studied this field of technology, particularly with the intention of integrating a broadband array antenna aperture operating in the frequency range 6 to 18 GHz with a vehicle. The antenna is provided with a thin aperture. The array antenna may, for example, be used for radar and/or electronic warfare and/or communication.

In some cases so called frequency selective surfaces are used to reduce the radar cross section of antennas. This technology may be usable for frequencies outside the antenna operational band and also within the antenna operational band, for single polarized antennas, for polarizations of the electromagnetic field that is orthogonal to the polarization of the antenna. A frequency selective surface operating within the antenna operational band is not feasible for broadband array antennas due to the large frequency bandwidth of such antennas.

A vehicle hull integrated antenna without any particularly designed transition that may comprise an intermediate medium, material and/or structure between aperture and the vehicle hull, normally gives rise to a high radar cross-section. This is mainly caused by scattering at the edges of the antenna aperture caused by the difference in electromagnetic impedance between the aperture and the vehicle hull.

The problem is found to be particularly hard to handle when it comes to small, broadband, array antennas because of impedance differences arising over a broad frequency band, and because a small antenna array gives rise to a scattered field having a large beamwidth and high side lobes, which reduces the possibility to physically angle the surface of the aperture away from threat sectors.

The Radar Cross-Section of an array antenna suitable for use together with the present invention may depend on a number of factors including: the transition between the aperture and vehicle hull or air (hull integrated antenna or antenna in free space), the thickness of the aperture, the distance between antenna elements, the arrangement of the antenna elements in the aperture, the orientation of the edges of the aperture, mechanical accuracy and precision, the complex impedance of each antenna element as seen into the antenna from the outside, bandwidth, and polarisation. This is true for so called active antenna arrays wherein the distribution network behind the antenna is not directly visible to incoming signals from the outside. If the distribution network is visible, reflections therein may produce a large Radar Cross-Section. Negative influence of some of the factors mentioned above are sometimes relative easy to take care of, such as the distance between antenna elements, the arrangement of the antenna elements in the aperture, the orientation of the edges of the aperture. Other factors such as the transition between the antenna aperture and the vehicle hull are generally more difficult to handle.

Therefore, according to a first aspect, the present invention is providing an antenna frame for a flat microstrip array antenna suitable for a vehicle, the frame being intended to reduce radar-cross section of the vehicle when the antenna and the frame is attached to the vehicle wherein,

- the frame is arranged to surround the antenna aperture periphery, continuing the flat appearance;
- the frame comprises a transition region that, when seen in cross section, have a first width where the frame forms a gradually phased out section in a direction from the surrounding frame towards a so formed recess or void wherein the antenna with a gradually phased out section is intended to be placed, and wherein;
- a first absorbent material is attached to the phased out frame section to be clamped between the phased in antenna section and phased out frame section.

Further the antenna frame may comprise a cavity arranged beneath the transition region, when seen in cross section and antenna aperture facing upwards;

The antenna frame may comprise one or more second absorbent material layers arranged on, or forming the cavity walls, or completely filling the cavity.

The cavity may be shaped as a slot having an upper planar delimitation and a lower planar delimitation.

The slot may have an opening facing towards the antenna.

The antenna frame may comprise a tapering profile ending in a tip.

The slot may have a width being 0.5 to 5 wavelengths at highest operational frequency.

The slot may have a width being 0.5 to 3 wavelengths at highest operational frequency.

The first width of the transition region may be 0.5 to 4 wavelengths at highest operational frequency.

The antenna frame may be made of aluminium or composite material.

According to a second aspect, the present invention is providing an antenna assembly comprising the antenna frame of above and a flat microstrip patch array antenna wherein a half microstrip element is arranged at the periphery of the antenna aperture at the transition between the hull and the antenna aperture.

The antenna assembly wherein an antenna dielectric plate covers the microstrip elements and wherein the dielectric plate and the tapering of the tapering profile are adjusted such that the magnetic material fits close between the phased in antenna section and phased out frame section; and at the same time provides a flush upper surface of the frame and the antenna together.

The antenna frame or an antenna assembly, wherein the first and the second absorbent materials may be magnetic absorbent materials.

According to a third aspect, the present invention is providing a vehicle comprising an antenna frame or an antenna assembly according to above.

BRIEF DESCRIPTION OF THE FIGURES

The invention will now be further explained with the aid of one or more embodiments of the invention in conjunction with the accompanying drawings of which.

DETAILED DESCRIPTION OF VARIOUS EMBODIMENTS

Definitions and Symbols

The following terms and symbols will be used in this document with the following well defined meanings:

"Antenna element" is a term having two meanings. In single antenna terminology, an antenna comprises antenna elements, i.e., antenna parts. In array antenna terminology, an antenna element is one of the antennas in the array.

"Radar cross section" in this document denotes what is commonly meant with radar cross section, i.e., the area of a fictitious perfect reflector of electromagnetic waves that would reflect the same amount of energy back to the radar as the actual target. Often abbreviated as RCS.

"Antenna aperture" this expression, for the purpose of this application, refers to the radiating portion of the antenna, the "opening" of the antenna. The antenna elements are located in the antenna aperture.

"Substrate" is a layer with a dielectric material.

"Impedance matching" is used in its conventional meaning in the present application.

"Vehicle" means any vehicle such as aircraft, ship, or land vehicle.

"Thin" and "thick" for the purpose of the present invention and when nothing else is clear from the context, "thin" is a measure of thickness equal or less than about 1/10 of a wavelength, while "thick" is correspondingly a measure of thickness equal or greater than about one (1) wavelength.

Antenna Aperture Mounting Frame

The invention relates to the design of a transition between a broadband array antenna and a surrounding vehicle hull in order to achieve small radar cross section. Such a transition may be integrated in a component that here is called an "antenna aperture mounting frame", that is, a frame for surrounding the antenna aperture, and make a transition to the surrounding vehicle hull both mechanically and electrically. The purpose of such a frame according to the invention is to prevent or lower an increase of the radar cross section of the vehicle to which the antenna is mounted when the antenna is mounted.

In order to achieve low radar cross section, it is material that the antenna aperture itself is thin. Virtually all prior art thin broadband array antennas that can be found in the open literature are constructed according to the principle of multilayer printed circuit board (PCB) wherein one or more layers of dielectric material (substrate) are put on top of each other with some kind of microstrip elements between two adjacent layers of dielectric material.

These types of antennas are often provided with a relative thick substrate of low dielectric constant, closest to the antenna earth plane. On top of that is usually a microstrip element arranged. On top of the microstrip element is arranged a number of different substrates to achieve good impedance matching.

Figure 1:
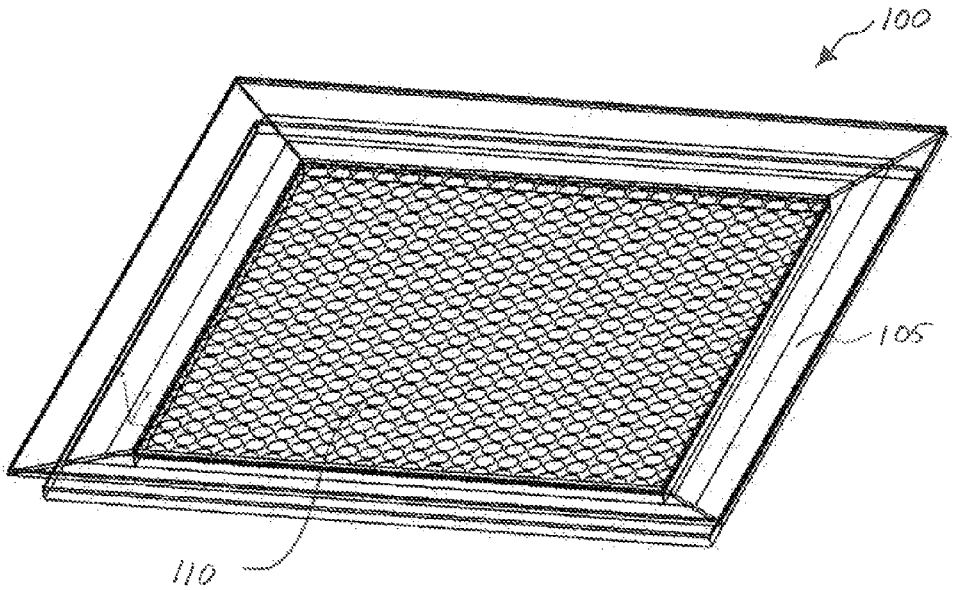
FIG. 1 shows a perspective transparent view of an antenna aperture provided with a frame.
Figure 2:
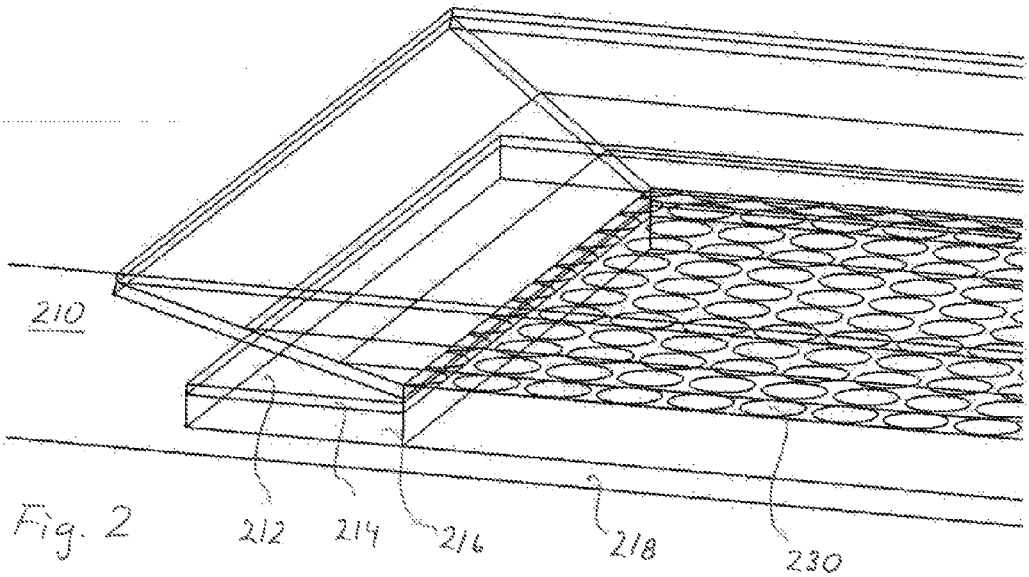
FIG. 2 shows, in close-up, a perspective transparent view of the aperture and frame of FIG. 1.

In FIG. 2 is shown a multilayer antenna element to be part of the present invention. Since the invention relates to the problem of creating a suitable transition between broadband array antennas of multilayer structure and the surrounding hull, the invention is applicable to virtually all today known thin, broadband, array antennas suitable for hull integration with low radar cross section.

The inventors have realized that, for an antenna not having a particularly designed transition between antenna and hull, the scattering originating from the transition is a result from the fact that the antenna and the hull possesses different electromagnetic impedances. The impedance difference for a given antenna and a given vehicle hull of a certain material is additionally a function of frequency, polarization an angle of incidence. For a vehicle provided with an antenna transition frame according to the present invention scattering is reduced by the transition frame which creates a soft transition from the impedance of the antenna to the impedance of the vehicle hull over a certain physical distance.

Figure 4:
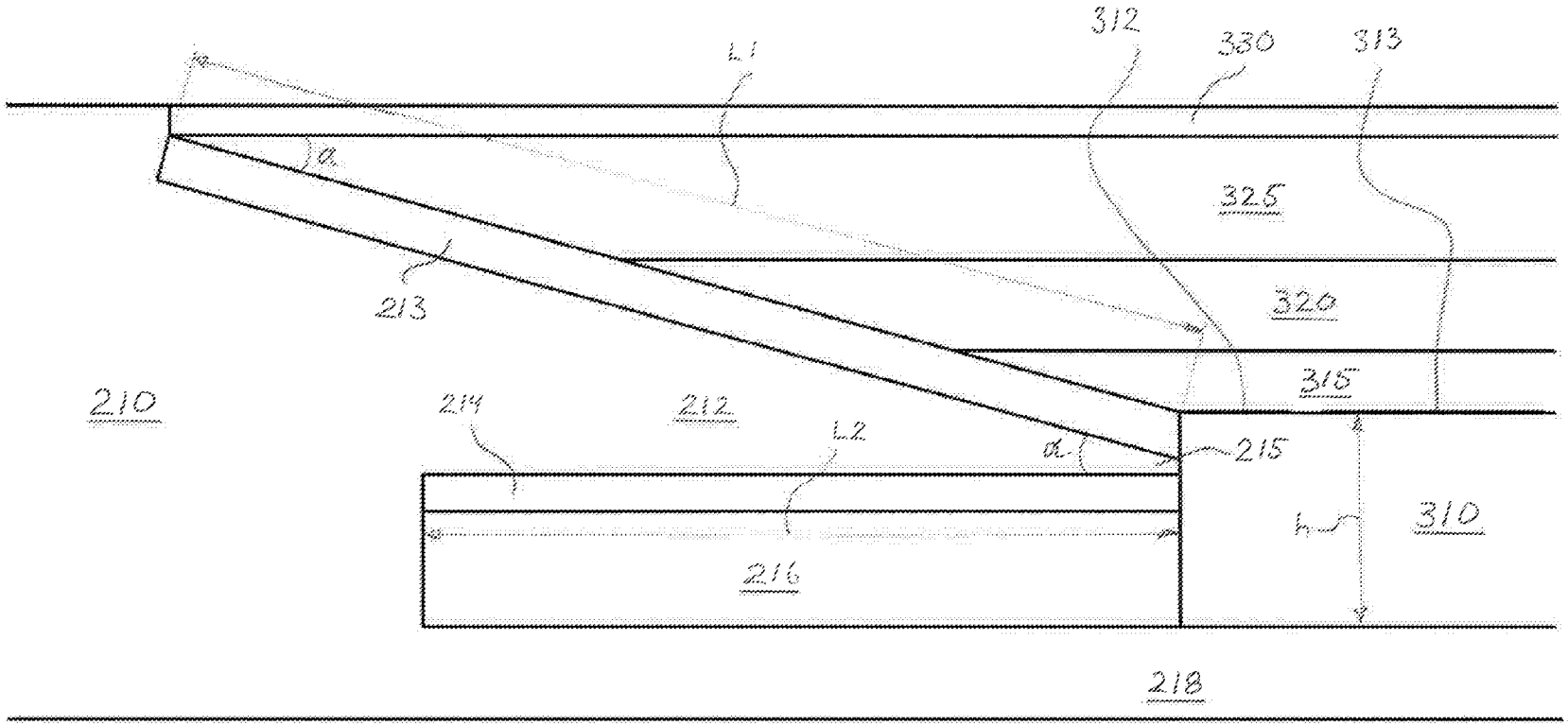
FIG. 4 shows, in close-up, a side view in cross section of the aperture and frame of FIG. 1.
Figure 5:
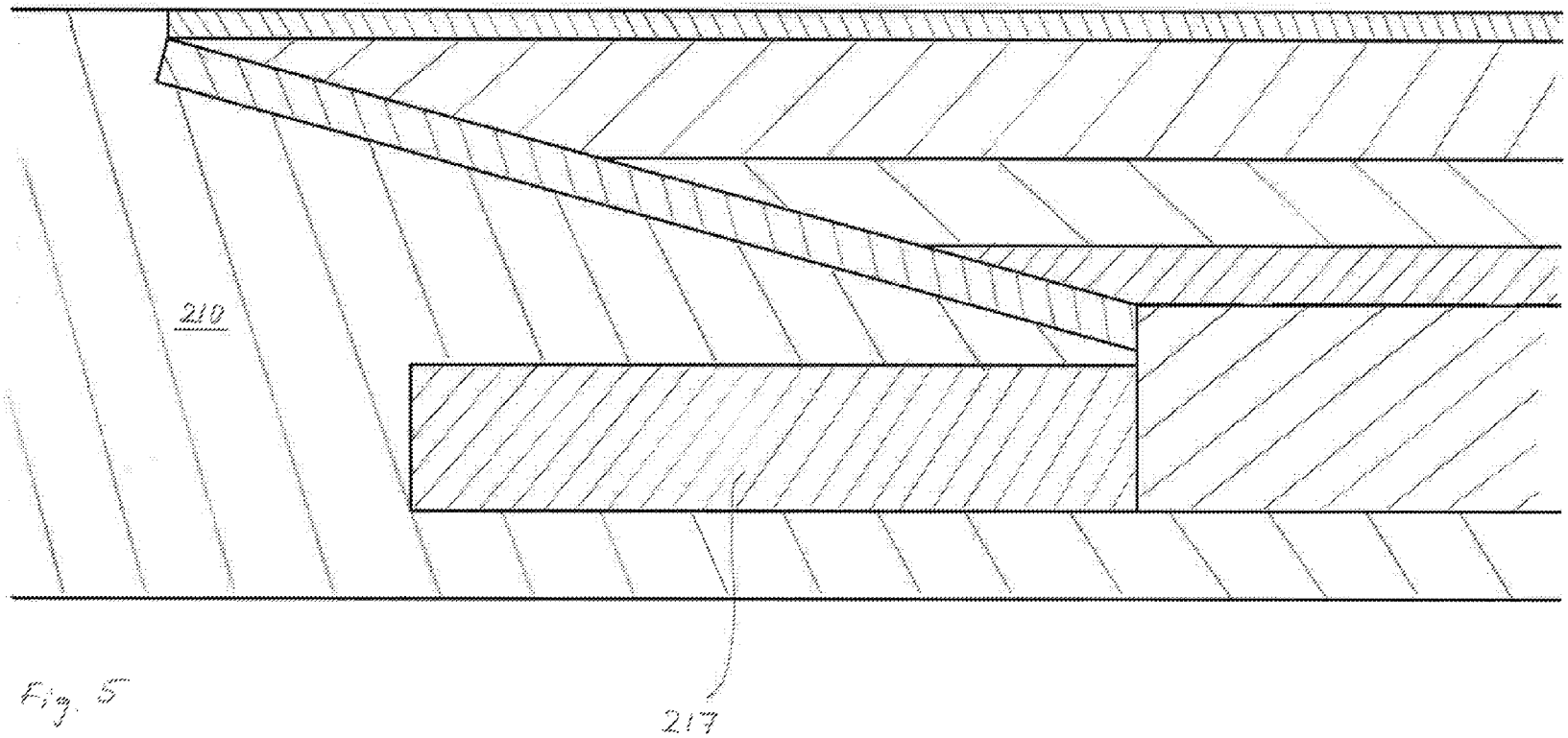
FIG. 5 shows, in close-up, a side view in cross section of an aperture and frame of wherein a slot is filled with bulk absorbent. The figure is provided with cross-section hatching.
Figure 6:
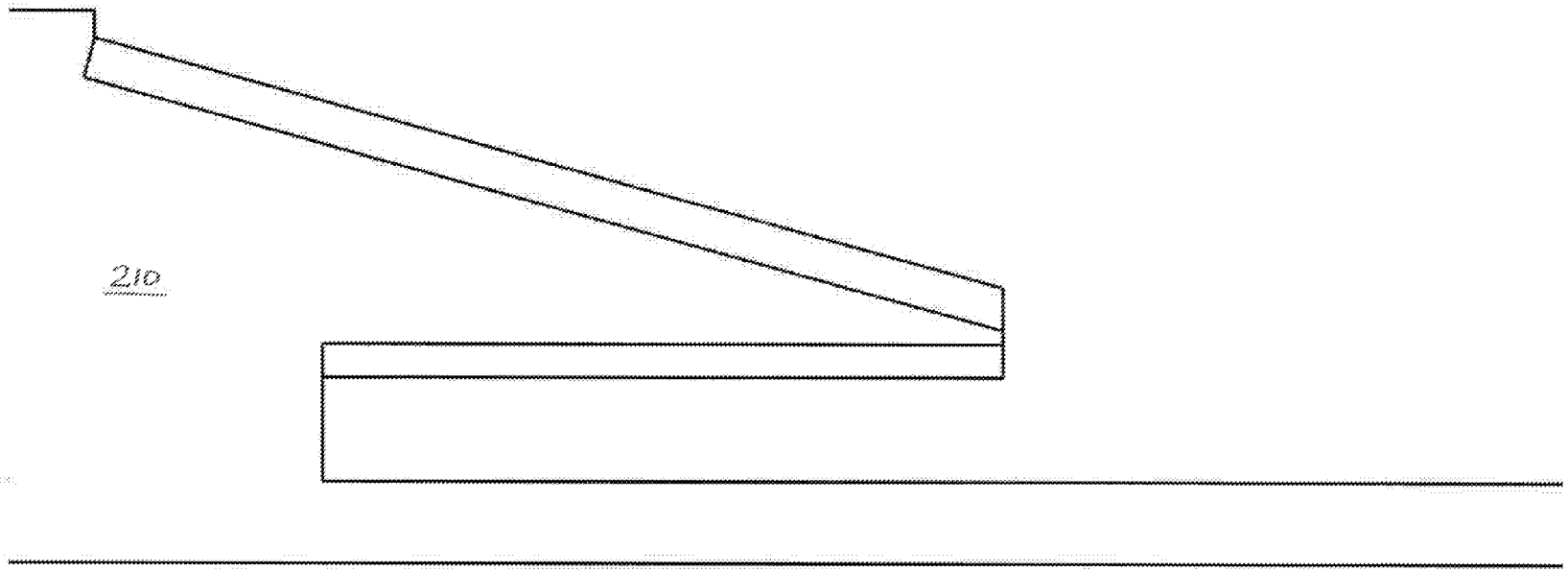
FIG. 6 shows, in close-up, a side view in cross section, of a frame only.
Figure 7:
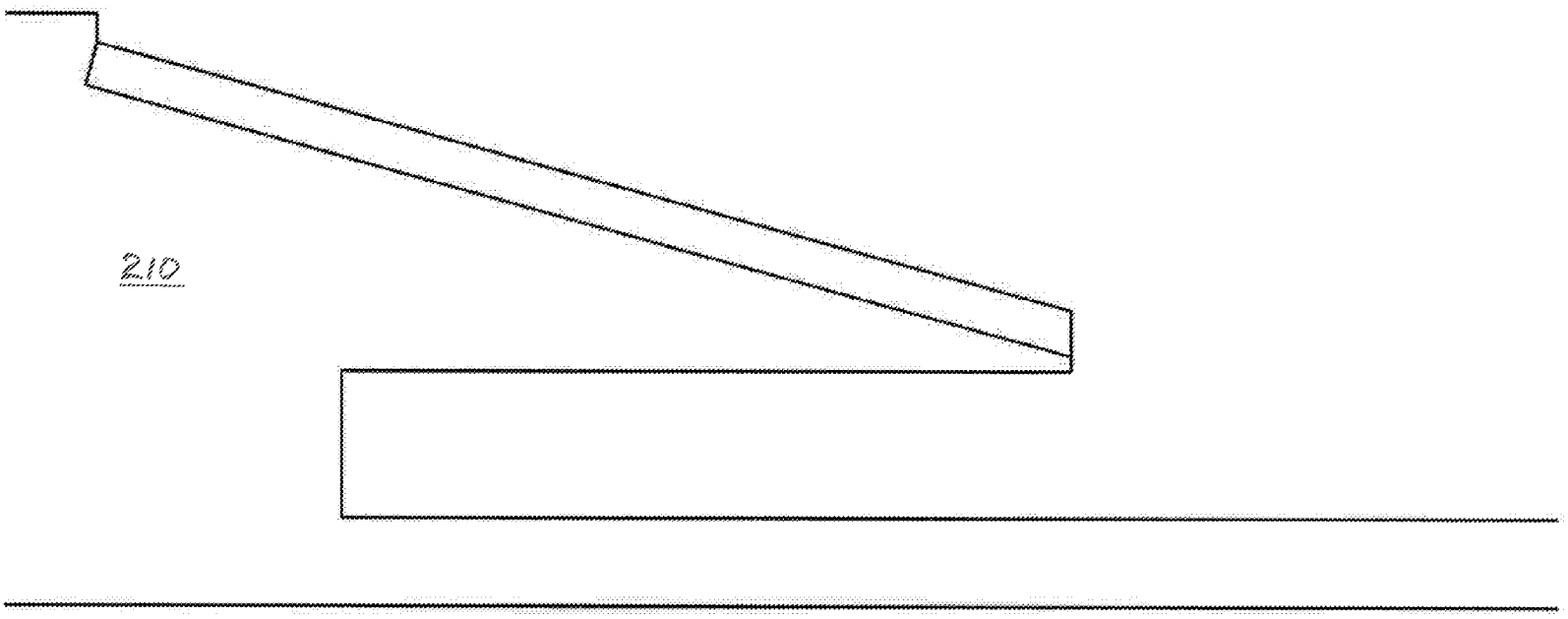
FIG. 7 shows, in close-up, a side view in cross section, of a frame only.
Figure 8:
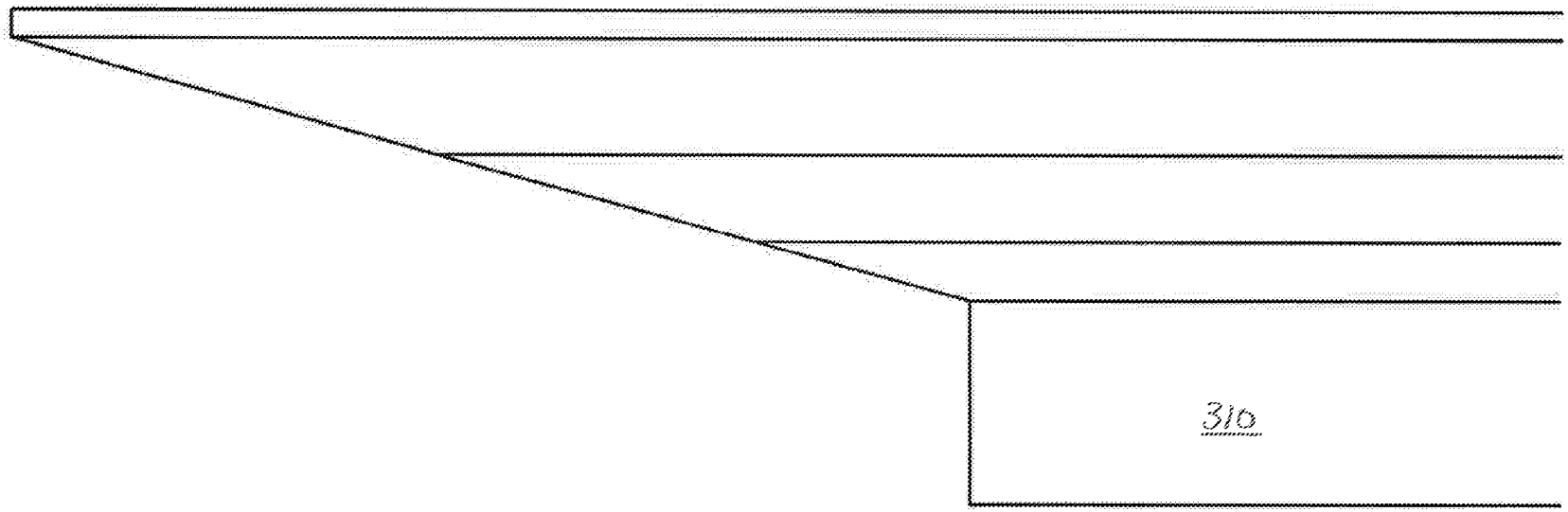
FIG. 8 shows, in close-up, a side view in cross section of an antenna only.
Figure 9:
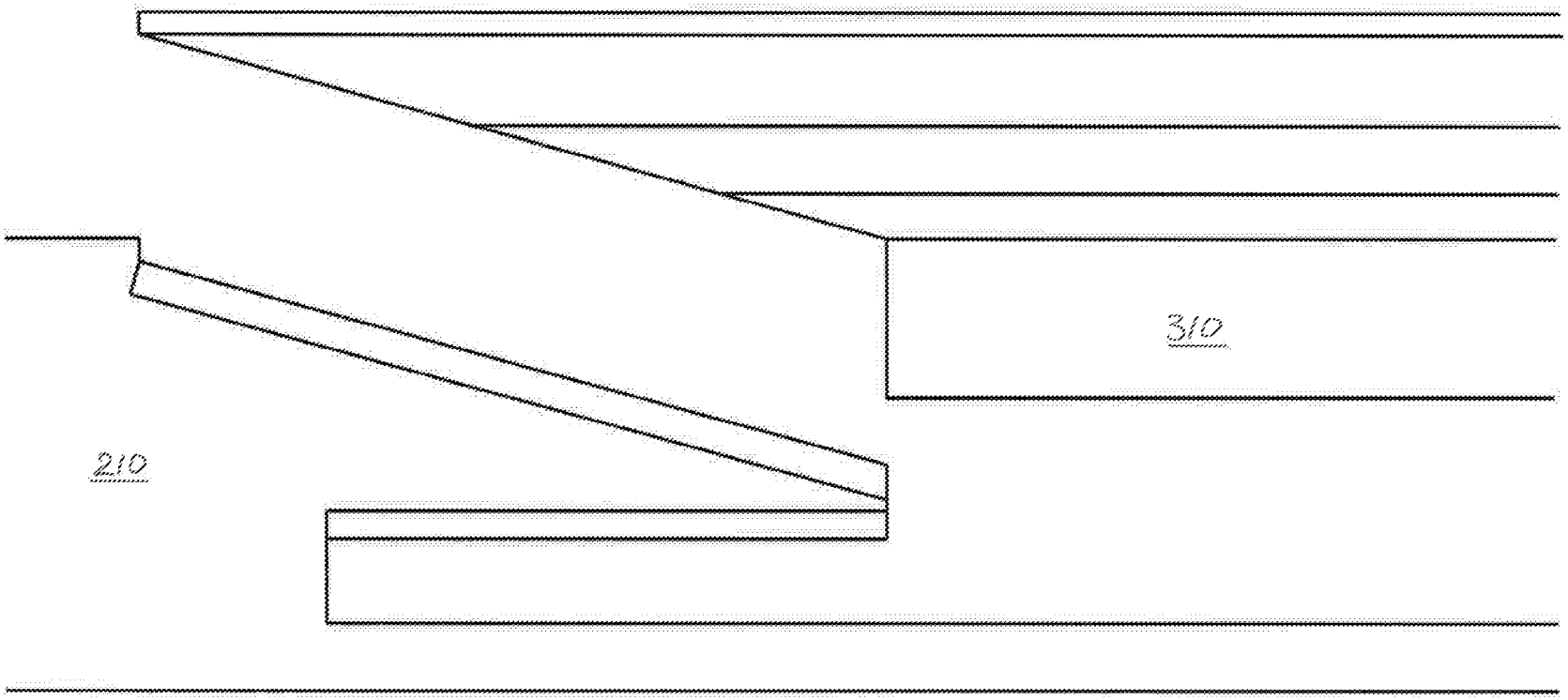
FIG. 9 shows, in close-up, a side view in cross section of an antenna and frame separated for clarity.

The inventors have studied a number of different concepts regarding transitions, and found that one of the inventive concepts shows surprisingly good performance. The concept showing these good simulation results are a concept that creates a gradual transition between antenna aperture and hull in a way that is shown in FIG. 4. A number of variants of this concept have been the subject of further simulations, and the specific transition of FIG. 4 shows particularly good performance.

Figure 3:
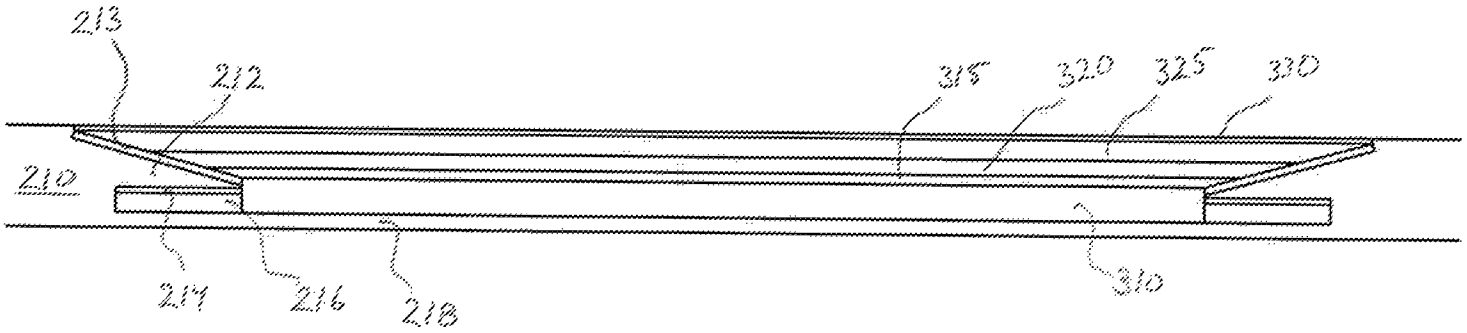
FIG. 3 shows a side view in cross section of the aperture and frame of FIG. 1.

FIG. 4 shows a gradually decreasing thickness of the frame material in the direction from the frame periphery towards antenna periphery. Thus, an elongated edge of the frame facing the periphery of the antenna comprises a tapering profile 212, and the profile ends in a tip 215 abutting the antenna periphery. The tip 215 is preferably squarely cut to be able to better about the base substrate 310 of the antenna. The edges of the antenna, on the other hand, may advantageously be beveled as shown in e.g. FIG. 4. To be able to describe this, one should first look at the layered design of the antenna aperture. Now, referring to FIGS. 3 and 4, the antenna aperture comprises an antenna base substrate 310. On a top surface of this antenna base substrate 310 is arranged microstrip antenna elements 312, 313 to form an array pattern of microstrip patches of the antenna. On top of the microstrip patches are arranged an antenna first dielectric layer 315, an antenna second dielectric layer 320, an antenna third dielectric layer 325, and advantageously also an antenna fourth dielectric layer 330. The outermost antenna dielectric layer (fourth or third) is advantageously chosen from a material to effectively withstand environmental weather conditions.

The material of the antenna frame is preferably provided to be the same as the material of the vehicle hull to avoid that the frame itself gives rise to increased RCS. For example, a vehicle with an aluminium hull should have a frame of the same or similar aluminium alloy. A vehicle with a composite hull should have an antenna frame preferably of the same composite material as the hull.

The tapering profile 212 of the antenna transition frame and the first, second, third and, when present, the fourth dielectric layer are arranged to engage a thin first absorbent layer 213 of magnetic absorbent material 213 that is arranged between the tapering profile of the antenna frame and the antenna to further reduce scattering and thereby the radar cross section, RCS.

This is preferably achieved by arranging the first dielectric layer 315 to cover, at its lower surface, precisely the antenna base substrate, and then cover increasingly greater area as distance above the base substrate layer 310 increases. The second and following dielectric layers follow continuously such that gradually a larger area is covered by the dielectric layers as distance above the base substrate layer 310 increases.

Thus, a dielectric stratified plate built up of the first, second etc dielectric layers 315, 320, 325, 330, is beveled from below to form an acute angle $\alpha$ corresponding to an acute angle $\alpha$ of the tapering profile 212 of the frame 210, such that a close fit is achieved when antenna and frame are assembled with the first absorbent layer upper surface arranged all the way of the lower boundary L1 of the dielectric stratified plate. The lower surface of the first absorbent layer makes close fit to the upper surface of the tapering profile 212 of the frame 210.

The acute angle $\alpha$ is governed by the length of the transition and by the thickness of the antenna. The length of the transition is governed by RCS requirements. A longer transition facilitates a soft impedance transition between hull impedance and antenna aperture impedance. The softer the transition, the easier it becomes to achieve a low RCS figure. For most cases, an angel $\alpha$ of 2-30 degrees seems to be convenient.

A magnetic absorbent material 213 is preferably selected for this first absorbent layer 213 because it is advantageous for performance since the layer can be made thin and have proven particularly efficient to reduce surface currents. The material may be of the type GDS (Emerson & Cumming Microwave Products, Inc.) a thin, flexible, magnetically loaded silicone sheet.

A plate-like portion 218 of the frame 105 is arranged to extend all the way under the antenna to constitute an earth plane of the antenna. The earth plane 218 is seen as the lowermost portion of the frame when seen in cross section.

The frame may further comprise a slot 216, that is, a void of material extending between the nose and the earth plane in the vertical direction when seen in cross section. In a horizontal direction the slot is arranged to extend from a tip 215 of the nose 212 and away from the antenna a distance L2. This is said to be the depth of the slot 216. The depth of the slot is advantageously arranged to be of the magnitude as further detailed below. A second layer 214 of magnetic absorbent material is arranged filling an upper portion of the slot along the entire depth of the slot. The second layer of magnetic absorbent material may also completely fill out the slot. In this case the second layer may be of a bulk absorbent material. The purpose and function is to absorb surface currents. If these currents are not absorbed they are likely to give rise to radiation and consequently will give rise to increased radar cross section.

Another advantage is that both the first 213, and second 214 layers of absorbent material are positioned such that they are nor exposed to environmental conditions. They are protected from rain, sun, wind, insects, etc by the antennas dielectric layers 330, 325, 320, 315.

The microstrip elements of the antenna are positioned on a certain height h from the upper surface of the earth plane. A step of the frame, that is, the distance from the earth plane to the upper surface of the first layer of absorbent material 213 where it meets the antenna, is arranged to be of the same height h. The advantage of these same heights is to achieve a soft transition from an impedance point of view.

Further, the antenna may be arranged to provide microstrip elements at its periphery that are of half the surface area of the rest of the microstrip elements. The inventors have realized that this will create a soft transition from an impedance point of view. The opportunity to practically provide half the area may be dependent on the shape of the full microstrip elements.

The performance of the frame, or more correct, of the combined frame and antenna, with regard to radar cross section, should increase continuously with increasing slot depth L2. In practice the available space may be restricted, and that is why the depth L2 of the slot 216 also may have to be restricted. Particularly good results have been noted at a compromise slot depth of two wavelengths at 18 GHz.

The suggested frame is particularly advantageous for broadband RF radiation. A further advantage is that a frame, or antenna-frame combination, designed as described above is efficient for all type of polarizations of the incident electromagnetic field.

A further advantage of the frame is that the antenna function will not deteriorate, which otherwise may be the case with prior art measures. It may also be that antenna function may be positively affected. This however has not yet been fully confirmed.

EXAMPLES

Particularly good results, or good compromises have been achieved at simulations or tests with the following parameters:

L1: 0.5 to 4 wavelengths at the highest operating frequency of the antenna.

L2: 0.5 to 3 wavelengths at the highest operating frequency of the antenna.

It has also been found that RCS will be reduced further the longer the transition is made, i.e., with a greater value of the maximum of L1 and L2 the lower the RCS, other parameters unchanged.

As the transition and the frame surrounds the antenna aperture it will occupy a large area, in particular if maximum of L1 and L2 is large. This may not be acceptable due to limited hull area, which is particularly true for aircraft. This may be a factor limiting maximum of L1 and L2. It has been found that when maximum of L1 and L2 is greater than 3 to 4 wavelengths at highest operational frequency, the further improvement in RCS when maximum of L1 and L2 is increased further is not so pronounced. Therefore, L1 and L2 measures as of above are good guidelines.

The antenna frame may be manufactured of a quadratic or rectangular piece of sheet material wherein a recess or void is milled out, and wherein bevel of transition region L1 is milled subsequently. The slot may also be milled. Alternatively, the antenna frame may be built up by sandwiching layers of suitable materials and bond them together.

The invention claimed is:

1. A thin antenna frame for a microstrip array antenna suitable for a vehicle, the frame being configured to minimize a radar-cross section of the vehicle when the antenna and the frame are attached to the vehicle, wherein:

the frame surrounds an antenna aperture periphery of the microstrip array antenna;

the frame comprises a transition region that, when seen in cross section, has a first width;

the frame has a frame section with a gradually decreasing thickness of a material of the frame in a direction from a frame periphery towards the antenna periphery, so as to define, via the gradually decreasing thickness, a recess in the frame material, said recess being configured to house the microstrip array antenna, the microstrip array antenna having a corresponding section with a gradually decreasing thickness complementary to said gradually decreasing thickness of the material of the frame;

the frame has a tapering profile ending in a tip;

a first thin absorbent material is attached to the frame section with said gradually decreasing thickness of the material of the frame and clamped between the frame section with said gradually decreasing thickness of the material of the frame and the corresponding section of the microstrip array antenna with the gradually decreasing thickness complementary to said gradually decreasing thickness of the material of the frame; and an upper surface of the first thin absorbent material at said tip of the taper is at the same height as microstrip elements of the microstrip array antenna when it is housed in the recess.

2. The antenna frame according to claim 1, wherein a cavity is arranged beneath the transition region.

3. The antenna frame according to claim 2, wherein one or more second absorbent material layers are at least one of arranged on or forming the cavity walls, or completely filling the cavity.

4. The antenna frame according to claim 2, wherein the cavity is shaped as a slot having an upper planar delimitation and a lower planar delimitation.

5. The antenna frame according to claim 4, wherein the slot has an opening facing towards the antenna.

6. The antenna frame of claim 1, wherein the frame comprises a tapering profile ending in a tip.

7. The antenna frame according to claim 4, wherein the slot has a width of 0.5 to 5 wavelengths at highest operational frequency.

8. The antenna frame according to claim 7, wherein the slot has a width (L2) of 0.5 to 3 wavelengths at highest operational frequency.

9. The antenna frame according to claim 4, wherein the first width of the transition region is 0.5 to 4 wavelengths at highest operational frequency.

10. The antenna frame of claim 1, wherein the frame material is least one of an aluminum or a composite material.

11. An antenna assembly comprising the antenna frame of claim 1 and a microstrip array antenna, wherein a half microstrip element is arranged at the periphery of the antenna aperture at the transition between the hull and the antenna aperture.

12. The antenna assembly according to claim 11, wherein:

an antenna dielectric plate covers the microstrip elements;

the dielectric plate and the tapering of the tapering profile are adjusted such that the magnetic material fits close between the phased in antenna section and phased out frame section and at the same time provides a flush upper surface of the frame and the antenna together.

13. An antenna frame or an antenna assembly of claim 1, wherein the first and the second absorbent materials are magnetic absorbent materials.

14. A vehicle comprising an antenna frame or an antenna assembly according to claim 1.

* * * * *